US006223997B1

(12) United States Patent
Fulkerson et al.

(10) Patent No.: US 6,223,997 B1
(45) Date of Patent: May 1, 2001

(54) QUICK COLOR CHANGE POWDER COATING SYSTEM

(75) Inventors: Terrence M. Fulkerson, Parma; Andrew M. Peddie; Joseph G. Schroeder, both of North Royalton, all of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/337,939

(22) Filed: Jun. 22, 1999

Related U.S. Application Data

(60) Provisional application No. 60/100,764, filed on Sep. 17, 1998.

(51) Int. Cl.[7] ..... B05B 15/02

(52) U.S. Cl. ..... 239/112; 239/114; 239/704

(58) Field of Search ..... 239/8, 104, 106, 239/112, 114, 123, 305, 310, 325, 654, 690, 693, 704, DIG. 14

(56) References Cited

U.S. PATENT DOCUMENTS

| | | | | |
|---|---|---|---|---|
| 4,248,379 | | 2/1981 | Hollstein et al. . | |
| 4,302,481 | * | 11/1981 | Ribnitz et al. | 239/704 X |
| 4,615,649 | | 10/1986 | Sharpless . | |
| 4,824,018 | * | 4/1989 | Shreve | 239/114 |
| 5,056,720 | | 10/1991 | Crum et al. . | |
| 5,170,591 | | 12/1992 | Brielmaier et al. . | |
| 5,215,261 | * | 6/1993 | Frene | 239/112 X |
| 5,269,463 | * | 12/1993 | Burks | 239/654 X |
| 5,341,989 | | 8/1994 | Fulkerson et al. . | |
| 5,487,624 | | 1/1996 | Toyota et al. . | |
| 5,718,767 | | 2/1998 | Crum et al. . | |

FOREIGN PATENT DOCUMENTS

| | | |
|---|---|---|
| 29 30 121 | 2/1981 | (DE) . |
| 195 17 229 A 1 | 11/1995 | (DE) . |
| 195 19 092 A 1 | 11/1996 | (DE) . |
| 0 913 203 | 5/1999 | (EP) . |

* cited by examiner

*Primary Examiner*—Lesley D. Morris
(74) *Attorney, Agent, or Firm*—Calfee, Halter & Griswo

(57) ABSTRACT

A quick color change powder coating system has a powder supply, a powder pump that receives powder from the powder supply through a suction pick-up tube, a spray gun and a powder hose that connects the pump to the gun. The apparatus includes a purge air switch assembly and a first air source that provides air at purge pressure to a first inlet of the purge air switch assembly. A second air source provides flow rate air to a first pump inlet and atomizing air to a second inlet of the pump via a purge air switch assembly. Powder is drawn up the tube and into the pump by suction produced by flow rate air into the pump. A purge inlet is associated with the powder inlet to the pump. The purge air switch assembly operates in response to a purge control signal to connect purge air to the atomizing inlet at the pump and to the pump's purge inlet; whereby the pump, hose and gun can be purged at the same time. Purge air may also be provided between the pump and hose and between the hose and the gun to further increase purging efficiency. A powder hose cleaning device is also provided which includes a wiper device such as an annular seal that closely fits about the tube exterior. As the tube is, withdrawn, the wiper device knocks powder off the tube exterior back into the hopper to reduce clean up time and waste of powder.

24 Claims, 7 Drawing Sheets

QUICK COLOR CHANGE POWDER COATING SYSTEM

RELATED APPLICATION

This application claims the benefit of U.S. Provisional Patent Application Ser. No. 60/100,764 filed on Sep. 17, 1998, for QUICK CHANGE POWDER COATING SYSTEM, the entire disclosure of which is fully incorporated herein by reference.

TECHNICAL FIELD OF THE INVENTION

The present invention relates to powder coating systems. More particularly, the invention relates to methods and apparatus for cleaning powder coating systems to facilitate color change operations.

BACKGROUND OF THE INVENTION

Known powder coating systems typically include a powder source, a powder pump, a powder spray gun, a hose connecting the pump to the gun and a pick-up tube that feeds powder from the powder source to the pump. Powder coating systems usually are designed to work with a plurality of colors of powder coating material. For many such systems, especially larger systems that use a plurality of guns to apply powder to larger objects, the powder coating material of the previous color must be removed from the system before the next color of powder coating material can be used. In larger systems this can involve a significant amount of down time to clean all the powder out of the system including having to purge powder residue from the pick-up tube, the pump, the hose and the gun. The faster the purging can be accomplished, the less is the overall down time required for a color changeover.

Various purging systems have been developed including those shown in U.S. Pat. Nos. 4,248,379 and 5,341,989, owned in common by the assignee of the present invention, the entire disclosures of which are fully incorporated herein by reference. However, to date no single system effectively purges and cleans the pick-up tube, pump, hose and gun in a single operation without substantial disassembly of the system and with minimum operator involvement.

It is desired, therefore, to provide new methods and apparatus for purging powder coating system components with reduced time and effort in order to speed up a color change operation.

SUMMARY OF THE INVENTION

In accordance with one embodiment of the invention, a purging apparatus is provided for a powder coating system of the type having a powder supply, a powder pump that receives powder from the powder supply through a suction pick-up tube, a powder applicator such as a spray gun and a powder hose that connects the pump to the gun. The purging apparatus may include a purge air switch assembly. A first air source provides air at purge pressure to a first inlet of the purge air switch assembly. A second air source provides flow rate air to a first pump inlet and atomizing air for the pump to a second inlet of the purge air switch assembly. During powder spraying operations the atomizing air passes through the purge air switch assembly to a second pump inlet. Powder is drawn up the tube and into the pump through a powder inlet by suction produced by the flow rate air into the pump. A purge inlet is associated with the powder inlet to the pump. During color change operations, the purge air switch assembly, operating in response to a purge control signal from a controller, shifts the position of the purge switch to cutoff the normal atomizing air flow to the pump and connects purge air to the atomizing inlet at the pump and to a purge inlet near the powder inlet of the pump, whereby the pump, hose and gun can be purged at the same time. The present invention also contemplates the optional use of purge air into the flow rate air port of the pump.

In accordance with another aspect of the invention, apparatus is provided for cleaning a powder pick-up tube in a powder coating system. The apparatus includes a powder pick-up tube; means for mounting the tube on a vessel; a wiper device closely received on the tube exterior and stationary with respect to the tube; the wiper device removing powder from the tube exterior as the tube is at least partially withdrawn from the vessel.

The present invention also contemplates the methods embodied in the use and/or operation of the above described apparatus.

These and other aspects and advantages of the present invention will be apparent to those skilled in the art from the following description of the preferred embodiments in view of the accompanying drawings.

BRIEF DESCRIPTION OF THE DRAWINGS

The invention may take physical form in certain parts and arrangements of parts, preferred embodiments and a method of which will be described in detail in this specification and illustrated in the accompanying drawing which forms a part hereof, and wherein.

DETAILED DESCRIPTION OF THE PREFERRED EMBODIMENTS

Figure 1:
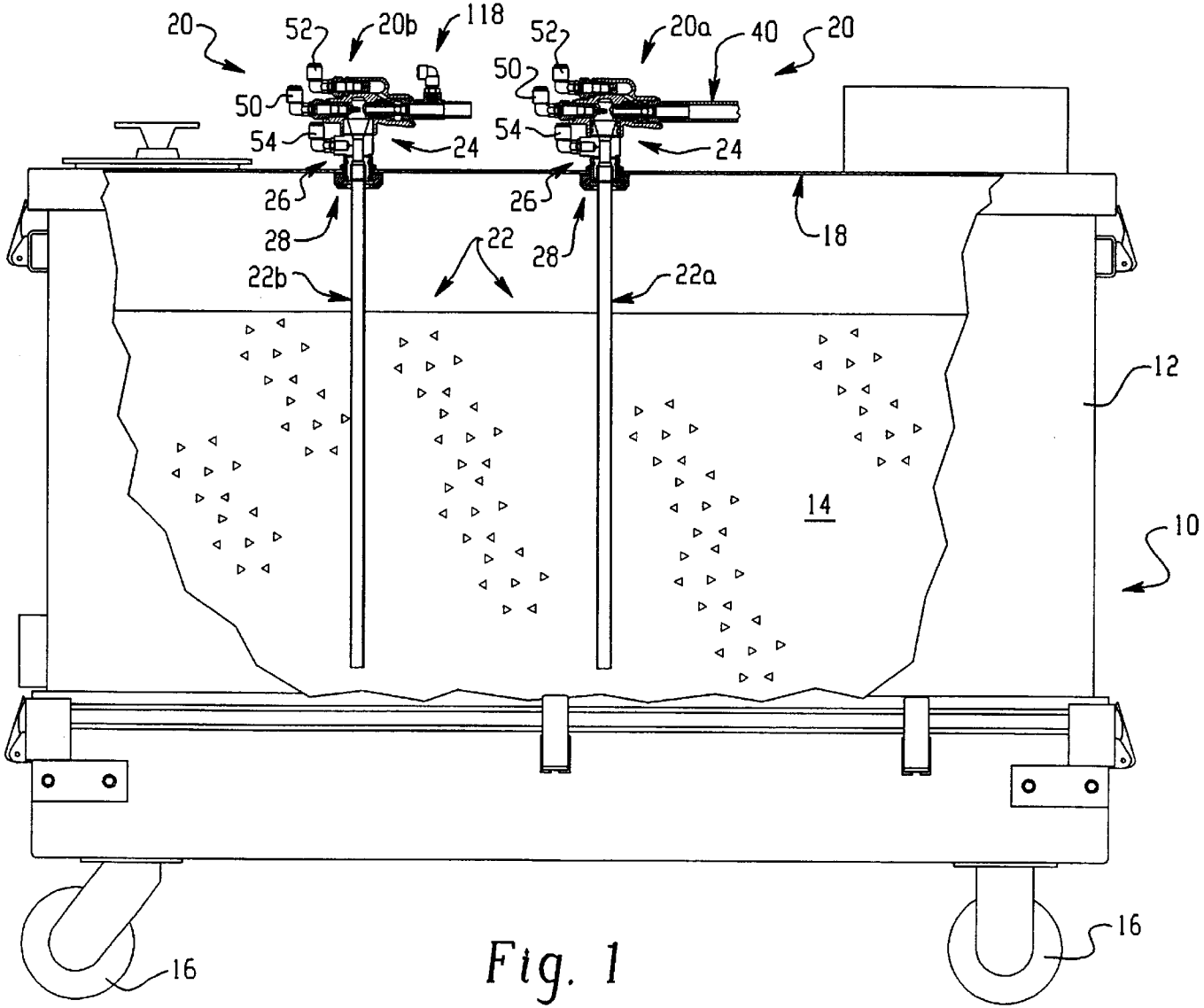
FIG. 1 is schematic representation in elevation and in partial section of a powder feed portion of a powder coating system including some aspects of the present invention.

With reference to FIG. 1, the present invention contemplates a powder coating system that can be more easily purged of powder during a color changeover or cleaning operation. Some of the basic system components are illustrated in FIG. 1 and include a powder hopper 10. The hopper 10 includes a vessel or tank 12 that is used to hold a quantity of powder 14 or other material that will be sprayed onto an object. In this embodiment, the powder in the hopper 10 is fluidized by blowing air into the hopper 10 through a porous membrane. A suitable hopper is available from Nordson Corporation as part no. 326838. However, other hopper designs and powder feed arrangements can be used with the present invention. As indicated in FIG. 1, the hopper 10 may be equipped with wheels 16 to facilitate transfer of the hopper 10 between locations.

Figure 2:
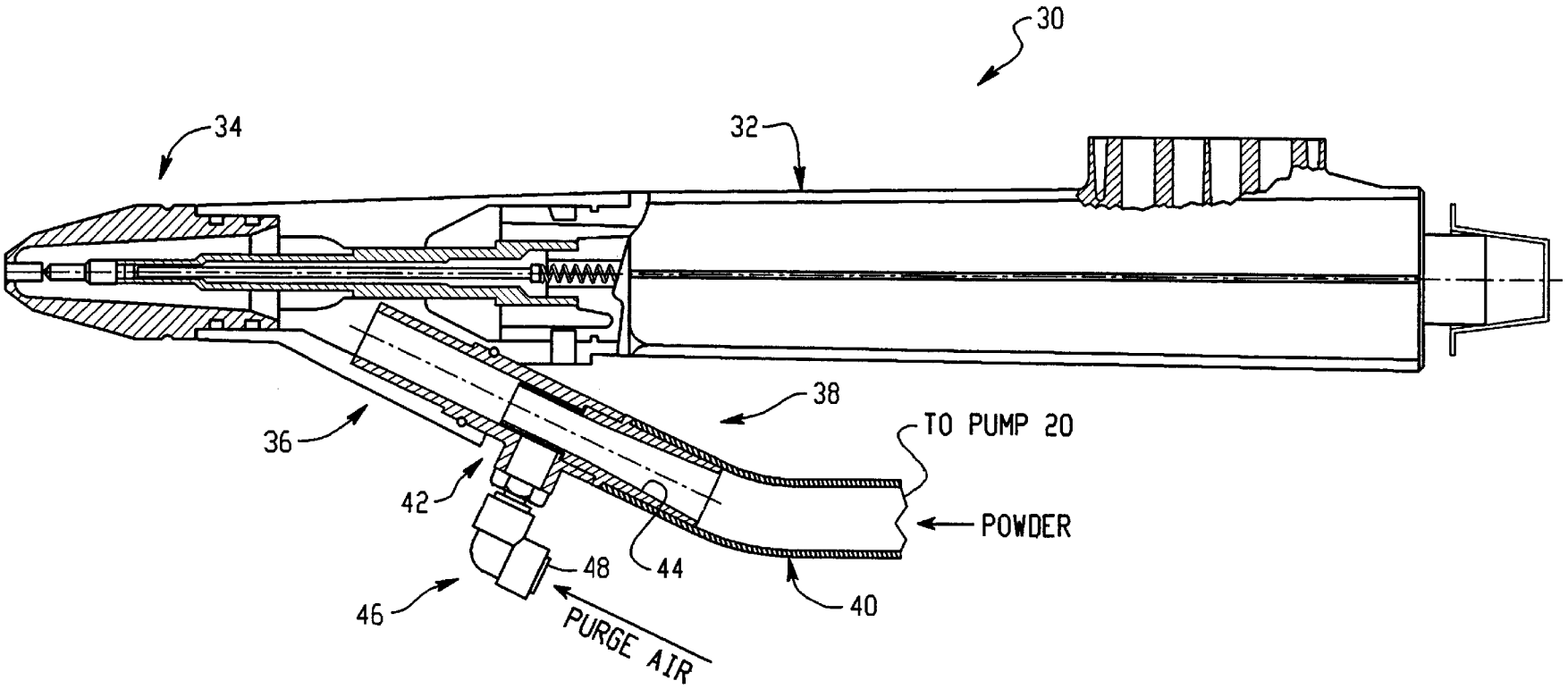
FIG. 2 illustrates a typical spray gun apparatus that can be used with the present invention.

The hopper 10 includes a cover 18 or other support structure across the top of the hopper. The support structure 18 is used to support one or more powder pumps 20. The pumps 20 will be described in more detail hereinafter. The pumps may be of the same or different design from one another. There is usually provided a separate pump 20 for each spray gun apparatus 30 (FIG. 2). Each pump 20 has an associated pick-up tube 22. Each pick-up tube 22 is an elongated tubular member that extends down into the powder supply 14 in the hopper 10. Each tube 22 is also coupled to a powder inlet 24 on a pump mount 26. Each tube 22 extends through the cover 18 by way of a cleaning device 28 as will be further described hereinafter.

An exemplary powder applicator 30 is illustrated in FIG. 2 and in this case is realized in the form of a powder spray gun. The gun 30 includes a gun housing 32 and a nozzle assembly 34. In this example, the gun 30 is an electrostatic spray gun such as the Versa Spray II Automatic Gun, part no. 173155 available from Nordson Corporation. Powder is supplied to the gun 30 via a powder inlet 36. A gun purge adapter assembly 38 is provided and serves as both a connection mechanism for a powder hose 40 and a purge inlet 42 adapter. The powder hose 40 is connected at one end to the gun adapter 38 by a slip fit of the hose 40 over a hose inlet adapter 44. The other end of the powder hose 40 is coupled to the outlet of an associated powder pump 20 (FIG. 1), in this example pump 20*a*. Thus, there is an associated powder pump 20 and hose 40 for each gun 30 used in the powder coating system (the powder hose for the second pump 20*b* in FIG. 1 is omitted but would connect the pump 20*b* powder outlet to another spray gun apparatus).

The purge adapter assembly 38 includes a hose fitting 46 that connects at an inlet end 48 to a purge air line (not shown in FIG. 2) and at another end to the purge inlet adapter 42. Thus, purge air is input to the gun from a purge air supply (not shown) which can be a conventional regulated pressurized air supply. The gun purge air adapter assembly 38 is fully described in the above-mentioned U.S. Pat. No. 5,341,989.

Each pump 20 (FIG. 1) includes a flow rate air inlet fitting 50, an atomizing air inlet fitting 52 and a pump purge air inlet fitting 54. Flow rate and atomizing air is supplied in a conventional manner from an appropriate pressurized air source, typically from a pressure regulator (not shown). Although the exemplary embodiments illustrated and described herein refer to the use of purge air into the atomizing inlet of the pump, persons of ordinary skill in the art will readily appreciate that the present invention also contemplates that purge air may also be optionally used through the flow rate air inlet 50. For example, purge air can be supplied to the atomizing inlet 52 and the flow rate inlet 50 at the same time.

A typical powder coating system would also include a booth enclosure (not shown) within which a coating operation takes place. The hopper 10 is attached to the booth on the outside and the spray guns are mounted to spray powder inside the booth at the object being coated. When it is desired to change the color of the powder being used, however, the pumps 20, hoses 40 and guns 30 must have the powder of the color which has been just previously sprayed cleaned off and purged from the inside workings of the associated pump, hose and gun. During a typical color change operation before the present invention, the pumps 20 were disassembled from the hopper 10 and the hopper 10 removed and replaced by another hopper having the new powder color. Prior to switching the hopper, however, the pumps, hoses and guns are taken apart and all of the components thereof are manually cleaned with compressed air. After cleaning, the components are reassembled. In some cases it may have only been needed to remove the pump without complete disassembly, however, some disassembly was still required. The present invention significantly simplifies and speeds up the color change process as will be apparent from the description herein.

Figure 3:
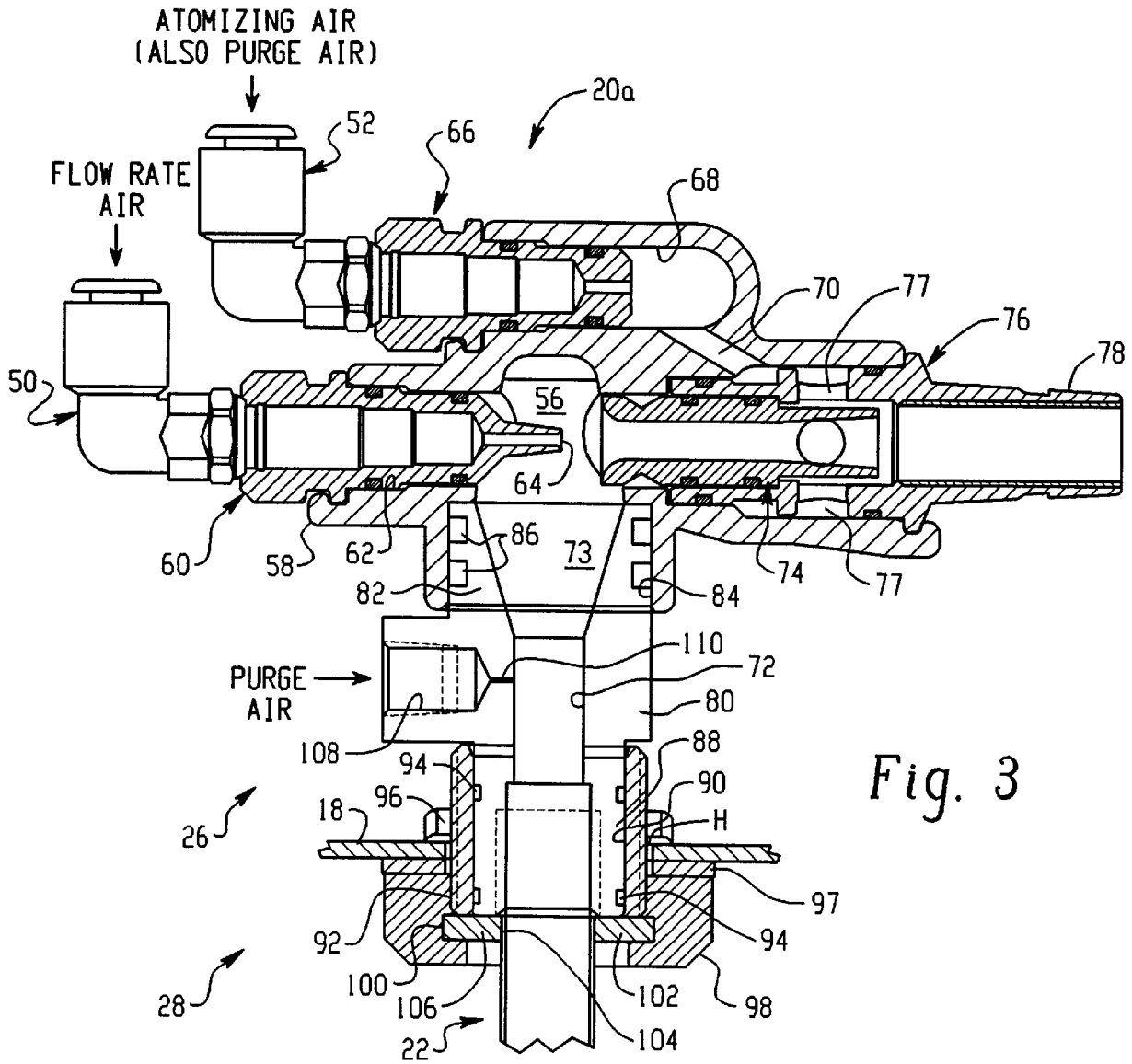
FIG. 3 is a detailed illustration of a powder pump and pump mount assembly in accordance with the invention.

With reference next to FIG. 3, a first powder pump 20*a* arrangement is illustrated in greater detail. The basic pump design is well known and available from Nordson Corporation as part no. 224713, and a detailed description is not necessary to understand and practice the various aspects of the present invention. The pump 20*a* is a venturi type pump and thus includes a venturi pumping chamber 56 provided in a pump body 58. A flow rate air nozzle 60 is mounted in a bore 62 and the nozzle is connected at one end to the flow rate inlet fitting 50. The nozzle has a discharge orifice 64 through which high velocity air is discharged into the pump chamber 56. This high velocity air creates a low pressure region within the pumping chamber.

The pump 20*a* also includes an atomizing air nozzle 66 disposed within a bore 68. The atomizing nozzle 66 is coupled at one end to the atomizing air fitting 52. Atomizing air (and as will be explained here after, purge air) enters the pump 20*a* downstream of the pumping chamber 56 through an air passage 70. The atomizing air is used to further diffuse the powder in the air stream leaving the pump 20*a*.

Each pump 20 is supported on a pump mount assembly 26. The pump mount 26 includes a central powder conduit 72 that opens into the pumping chamber 56 in the region of the flow rate air orifice 64. The opposite end of the conduit 72 is in fluid communication with the associated pick-up tube 22 via the tube cleaning assembly 28. Thus, the low pressure region created in the pumping chamber 56 by the high pressure flow rate air discharging from the orifice 64 creates a suction action in the pick-up tube 22, and powder from the hopper 10 is drawn up into the tube 22, through the conduit 72 and into the pumping chamber 56 at a powder inlet in the region generally indicated with the numeral 73. The powder and flow rate air then is pumped out of the chamber 56 through a discharge nozzle assembly 74. The discharge nozzle 74 is coupled to a discharge fitting 76 having a nipple 78 over which the powder hose 40 is slipped (FIG. 1). In an alternative embodiment, a second purge air inlet is provided to the powder hose at the pump 20*a* outlet as will be described herein after (see the description of the second pump 20*b*). The discharge fitting 76 includes ports 77 through which atomizing air from the air passage 70 passes and mixes with the powder and flow rate air in the discharge nozzle 74.

The pump mount assembly 26 includes a pump mount body 80 having the powder conduit 72 formed there through. The pump mount body 80 includes a first nipple end 82 that slides into a cylindrical bore 84 formed in an extension collar of the pump body 58. Seals 86 such as o-rings are provided as a seal and to frictionally secure the pump body 58 to the pump mount 80.

The pump mount body 80 includes a second nipple 88 that slides into another cylindrical bore 90 of a support collar 92. The support collar 92 is part of the tube cleaning device assembly 28. The second nipple 88 also may include seals 94 such as o-rings for example. The second nipple 88 includes an internally threaded bore 89 that mates with a threaded end of the pick-up tube 22 (best illustrated in FIG. 3A). By this arrangement, the pick-up tube 22 can be withdrawn from the hopper 10 through the cleaning device 28 by an operator pulling up on the pump mount assembly 26, which pulling action separates the pump mount 26 and the connected tube 22 from the support collar 92.

The tube cleaning device assembly 28 includes the support collar 92 which is externally threaded. The collar 92 partially extends into the hopper 10 through a hole H in the hopper cover 18. A threaded mounting nut 96 is mated with the threaded collar 92 on the outside of the hopper 10. A threaded retaining nut 98 is mated with the threaded collar 92 on the inside of the hopper 10. When the mounting and retaining nuts 96, 98 are tightened down against the cover 18, the collar 92 and pump mount body 80 and the pump 20 are securely supported on the hopper cover 18. A seal 97 may also be provided when required.

Figure 3B:
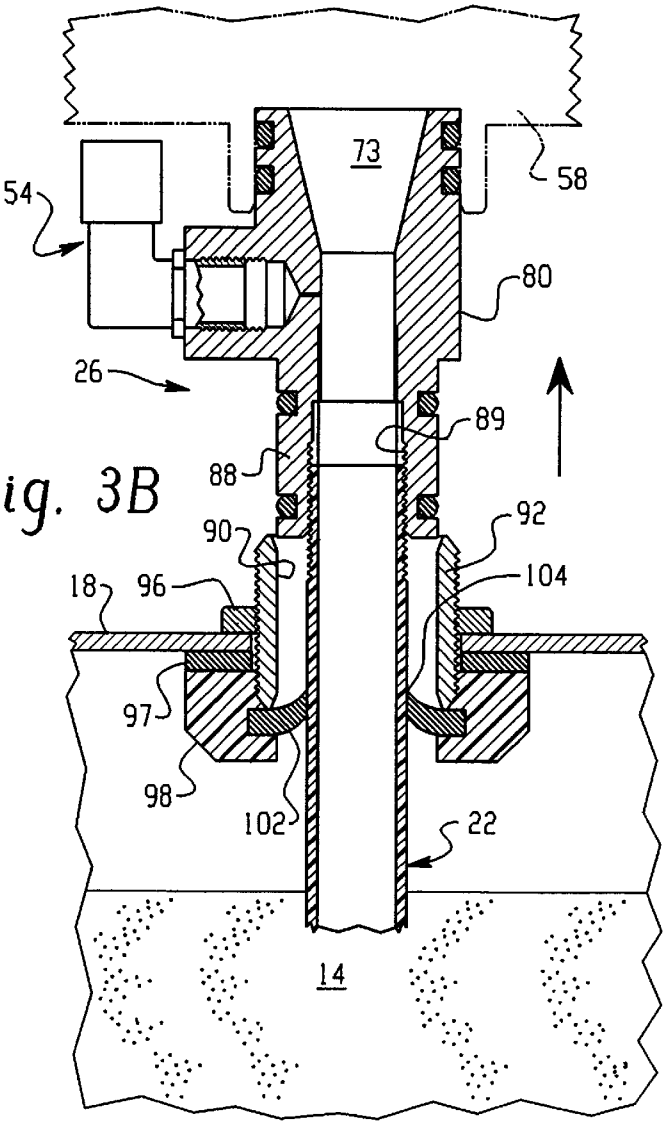
FIGS. 3A and 3B illustrate the wiping action of a tube cleaning device in accordance with the invention.
Figure 3A:
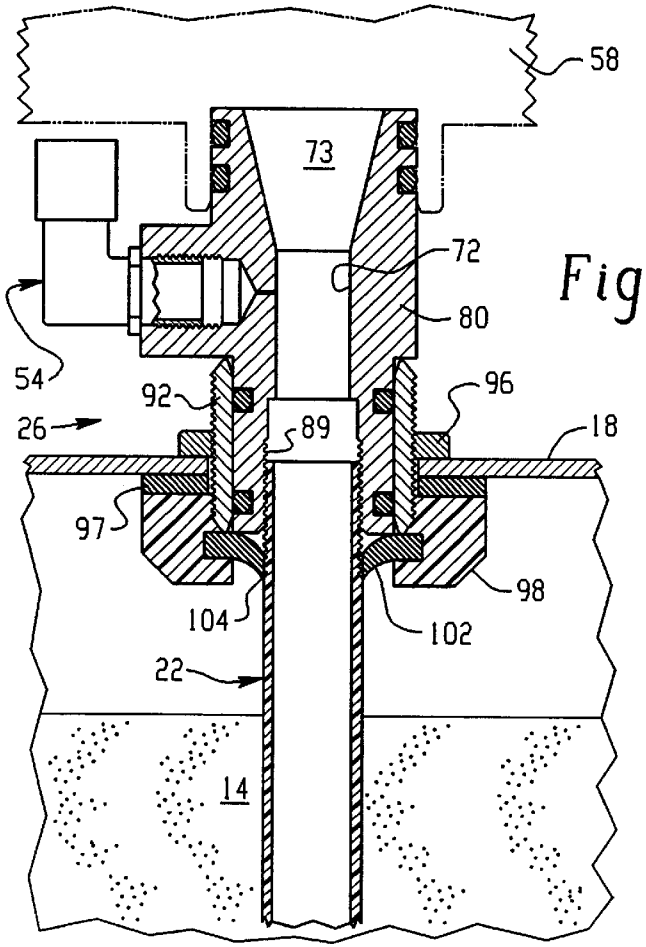

The retaining nut 98 includes and internal annular groove 100 that receives and retains a wiper device 102. In this embodiment, the wiper device 102 is realized in the form of a resilient polymeric annular seal or gasket having an inner annular surface 104 that is compressed against the pick-up tube 22 outer surface. An interference fit between the seal 102 and the tube 22 is preferably used. The seal 102 is preferably made of a firm but pliant rubbery material, for example gum rubber, that is compatible with the powder chemistry but that also will wipe the tube 22 outer surface efficiently. To this end, the inner annular portion 106 of the seal 102 is not supported on the lower side thereof. In this manner, when the tube 22 is lowered down through the device 28 ("down" in terms of the view of FIG. 1) the inner surface 104 deflects axially downward with a somewhat cone shape protrusion, as illustrated in FIG. 3A. When the tube 22 is withdrawn from the hopper 10 up through the device 28, the inner surface 104 inverts and extends somewhat conically and axially in the opposite direction, as illustrated in FIG. 3B. In this manner, the seal 102 applies an excellent wiping action somewhat like a squeegee effect to the exterior surface of the tube 22, removing much of the powder residue that clings to the tube 22 from the hopper. The seal does not necessarily remove all powder particles, but sufficiently cleans the tube surface so that the remaining powder is very easy to clean. As the seal 102 wipes the tube clean, the powder falls back into the hopper 10. A relatively clean tube 22 can therefore be removed from the hopper. This greatly reduces clean up time as the layers of powder caked on the outside of the tube are knocked down into the hopper 10 as the tube is withdrawn from the hopper. Prior to this invention, the powder caked onto the outside of the tube was cleaned off outside the hopper which was a messy and time consuming operation.

The pump mount assembly 26 further includes a purge function in accordance with another aspect of the invention. The mount body 80 includes a second bore 108 which in this example is transverse the powder conduit 72. The bore 108 is adapted to receive the pump purge fitting 54 (shown in FIGS. 1, 3A, 3B and 6) and at an opposite end thereto the bore 108 opens to the powder conduit 72 through a restricted orifice 110. Without the restricted orifice 110, full pressure purge air would enter the powder chamber 72, with the possible effect of back pressuring the pump 20 and thus possibly separating the pump 20 from the pump mount 26 during purge. However, with the various added purging capabilities of the present invention, including purging through the atomizing inlet 70, the purge pressure into the pump mount body 80 can be significantly lowered. This is accomplished through the restricted orifice 110. Purge air at source pressure is supplied to the orifice 110 from a purge air source (not shown in FIG. 3). This purge air has several effects. First, the purge air interrupts the suction in the powder conduit 72, thus preventing powder from being drawn up from the hopper 10 during a purging operation. Second, the purge air passes down through the pick-up tube in a reverse direction, thus cleaning the inside of the tube by blowing the powder in the tube 22 back into the hopper vessel 12. Third, the purge air passes through the pump 20 and out the hose 40, thus purging and cleaning the pump 20 interior.

Figure 4:
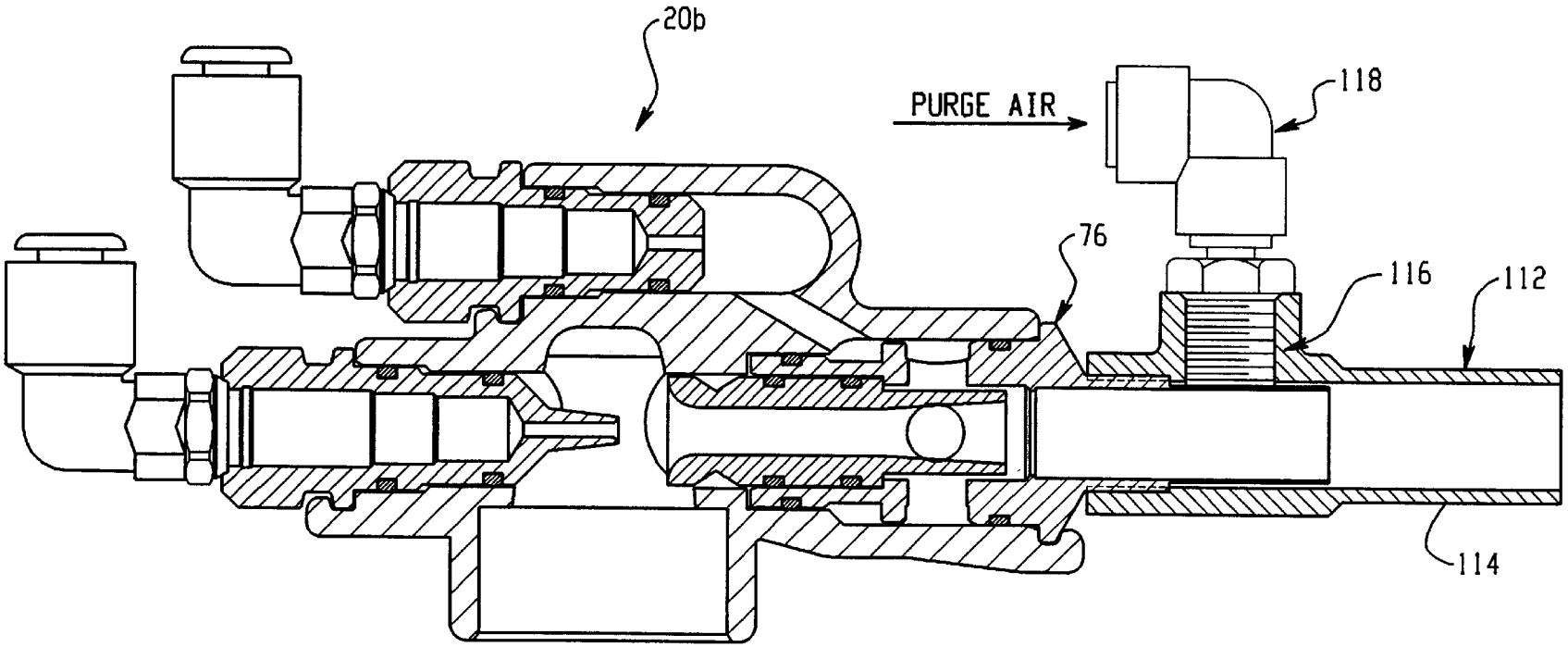
FIG. 4 illustrates an alternative embodiment wherein an additional purge air inlet is provided at the connection of the powder hose and powder pump.

With reference next to FIG. 4, an alternative embodiment for the powder hose is shown. FIG. 4 illustrates the second powder pump 20*b* of FIG. 1. The pump 20*b* is in this example identical to the first described pump 20*a*, and FIG. 4 is further simplified by omitting the pump mount 26 assembly. In this embodiment, the pump discharge fitting 76 has been modified to threadably receive a purge inlet adapter 112. The powder hose (not shown in FIG. 4) slips onto the discharge end 114 of the adapter 112. The adapter 112 also includes a purge air inlet 116 coupled to a hose purge inlet fitting 118. Purge air from a purge air source (not shown) is input to the adapter 112 through the hose purge inlet 118 during a purging operation. This purge air can be used to purge and clean the attached powder hose 40 and associated gun 30. This purge air could also be primarily used just to purge the hose 40, since additional purge air for the gun is provided to the gun purge inlet 46. By use of this purge inlet 118 at the pump discharge location, the purge pressure into the pump mount 26 via the orifice 110 can be even further reduced since the purge air into the pump mount via the inlet 54 will only be used to clean the tube 22 and pump 20*b*, while the purge air through the adapter 112 is used to purge and clean the associated hose 40 and/or gun 30.

Thus, the apparatus of FIGS. 1–4 illustrate a number of new purge function concepts that improve the cleaning and purging of the powder coating system. Purge air inlets are now provided not only at the hose/gun connection 38, but also at the atomizing inlet 52 and at the hose purge inlet 118. Another purge inlet is provided at the powder inlet 73 to the pump via the purge inlet 54 in the pump mount 26. Still further, it is important to note that, although in this embodiment the pump 20 is purged through the pump mount 26 purge arrangement, along with additional purging air entering through the atomizing inlet 52, purging air could also be input to the flow rate air inlet 50, either in place of purging air through the atomizing inlet 52 or in combination therewith. Forcing purge air through both inlets 50, 52 would substantially increase the volume of air through the system to clean the components. However, one advantage of applying purge air through the atomizing inlet 52 and not the flow rate air inlet 50 is to prevent a large suction in the pick-up tube 22. When purge air is blown through the flow rate air inlet 50 there can be a substantial suction produced that will tend to draw up powder from the pick-up tube 22, thus necessitating that more air be blown into the pump mount purge inlet 54 to break this suction. However, in some systems it may be advantageous to provide purge air to the flow rate air inlet 50.

All three main system components that require purging (the pump 20, the powder hose 40 and the gun 30) can thus be cleaned during a purging operation with a system designed to use all or various combinations of these purging functions. Alternatively, systems can be designed that only include purging of one or two of these main components, thereby utilizing less than all of the purging functions. As will next be explained, in accordance with another aspect of the invention, a system control is provided that automatically purges the pump 20, the hose 40 and the gun 30 to avoid the need for manually disassembling and cleaning these components, thereby considerably reducing color change time requirements.

Figure 5:
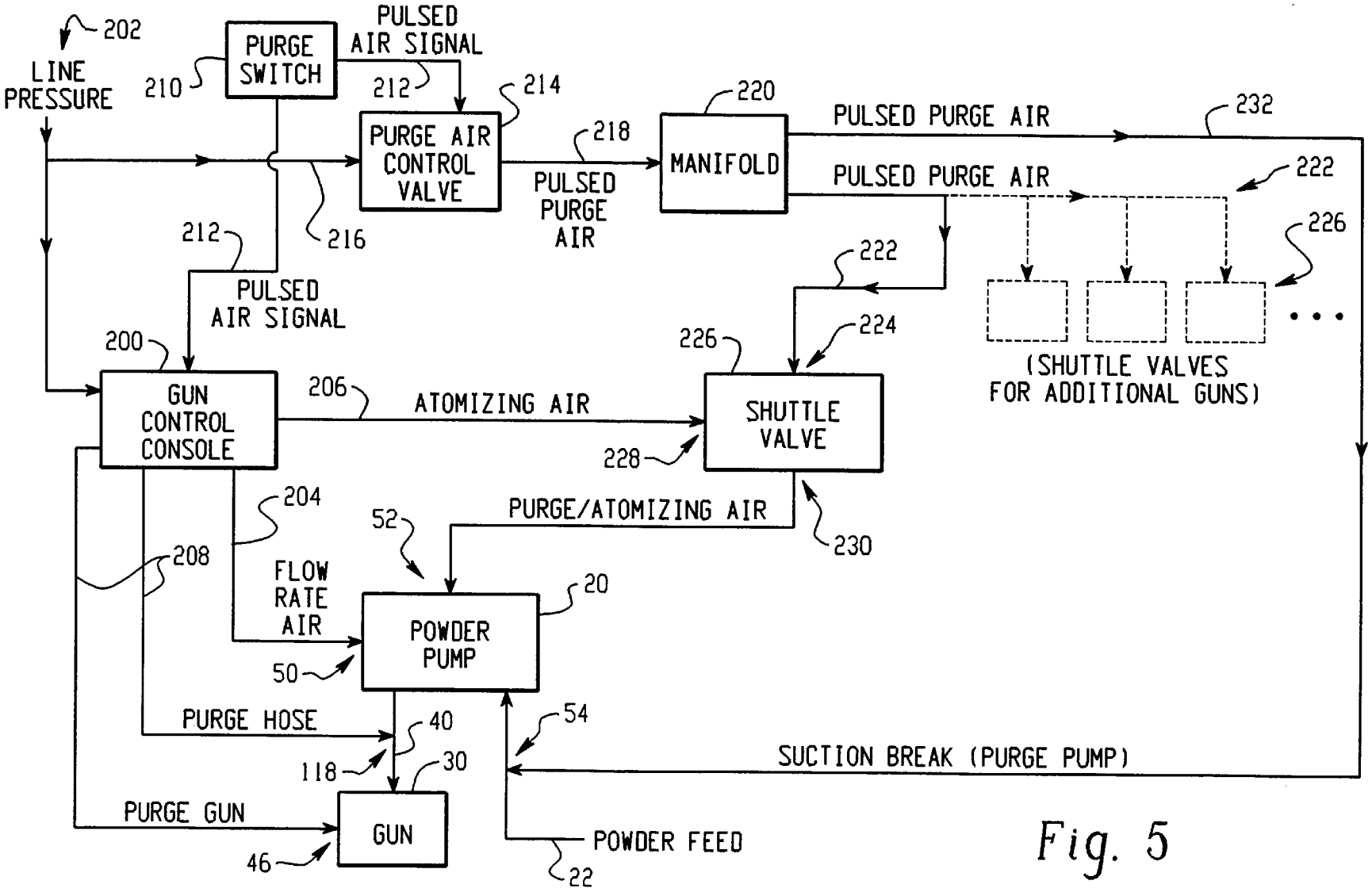
FIG. 5 is a simplified pneumatic diagram illustrating one embodiment of a purge control function.
Figure 6:
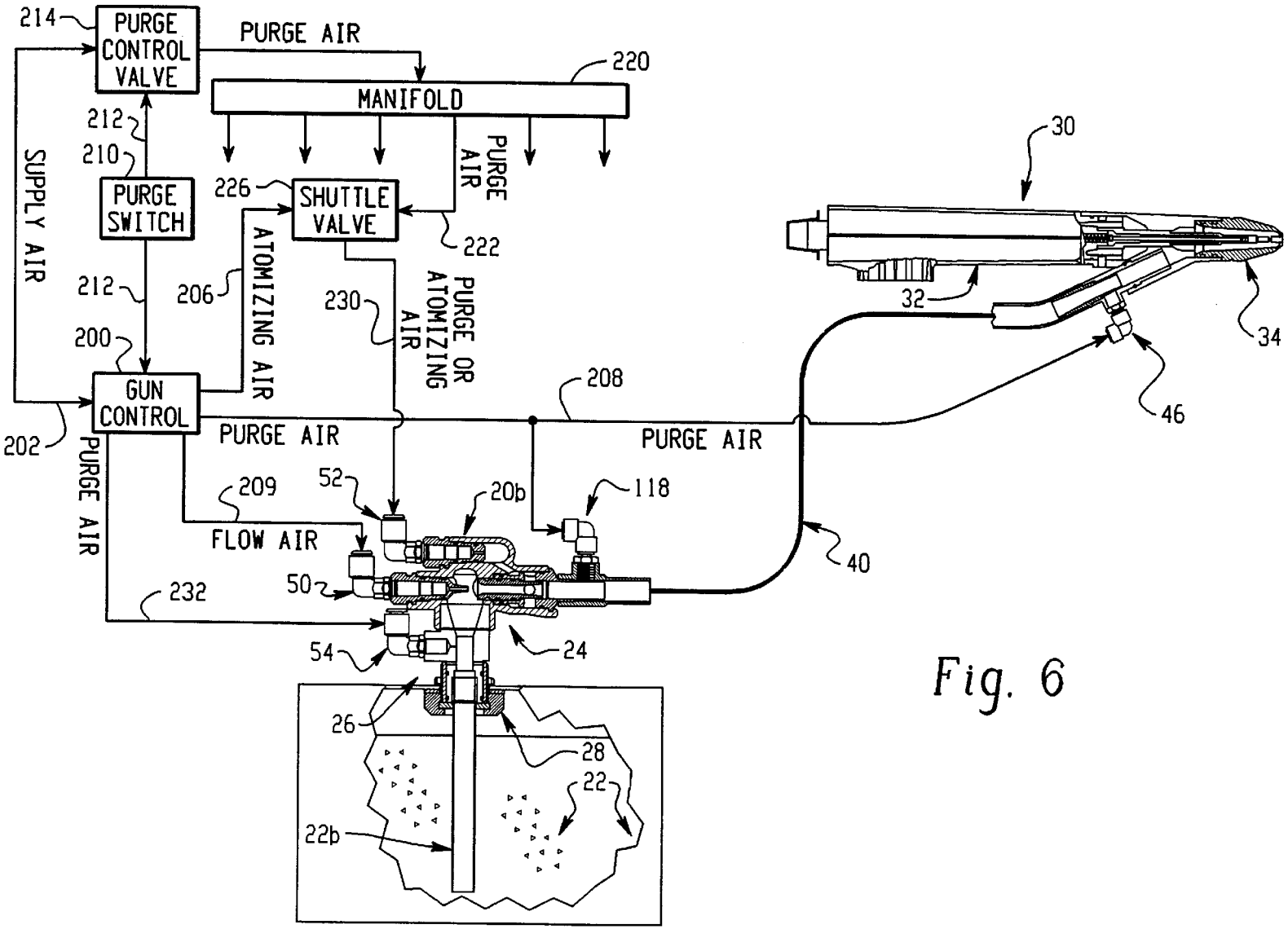
FIG. 6 illustrates a quick change powder coating system in accordance with the embodiments of the invention illustrated in FIG. 5.

FIG. 5 illustrates in a simplified schematic way one embodiment of a purge control function in accordance with the invention. FIG. 6 is similar to FIG. 5 but illustrates the implementation with the actual system components as previously described herein. FIG. 5 specifically illustrates the various pneumatic functions, with the various powder system components being represented by functional blocks (shown in actual implementation in FIG. 6). Numerals used in FIGS. 5 and 6 are used to designate corresponding structures previously described with reference to FIGS. 1–4.

In a typical powder coating system, each gun is controlled via a gun control module 200. This control function includes applying the appropriate voltage to the gun 30 electrode and also controlling the powder and spray pattern by controlling the flow rate air and atomizing air to the pump 20. These control functions can be conventional and are well known to those skilled in the art, and further are described in the incorporated patents herein. Such control systems have also been commercially used for a number of years, such as the Sure Coat® Automatic Gun Control Console (326168) available from Nordson Corporation, which system includes purge air control capability, as well as the Smart Coat® Controller described in U.S. Pat. No. 5,718,767 which is incorporated by reference herein in its entirety. Thus, the control operation 200 for the gun will not be described in detail herein as it is not necessary to understand and practice the present invention. It is simply noted that the gun control functions may include providing and regulating a source of purging air to the gun 30, the hose 40 and the pump 20, as well as flow rate air and atomizing air to the pump 20, and electrical power to the gun. The control function can also include a separate control and regulation of purge air as is known and identified herein above with the Sure Coat® System.

In accordance with another aspect of the invention then, source air 202 at line pressure is supplied to the gun module 200 which regulates and supplies flow rate air 204 and atomizing air 206. Flow rate air is input to the flow rate air fitting 50 on the pump 20. The gun control (or other suitable control function) also produces, from the source 202, purge air 208. This purge air is provided to the hose purge air inlet fitting 118 (FIG. 4 when used) and to the gun purge air inlet fitting 46 (FIG. 2). These purge air supplies may be from a common source or separate sources but are only activated during a purging operation.

In this embodiment, purge operations can be operator initiated by manually actuating a purge control switch 210. In this embodiment, the control switch 210 produces a pulsed pneumatic output signal 212 that is input to a first switching valve 214 and also is input to the control module 200. The switch can be, for example, part no. LPG 10/1 available from Compair Pneumatics. The control module 200 can use this pulsed pneumatic input to enable purge air flow 208, for example. Other control mechanisms for the purge air flow 208 could be used as required.

Although in this exemplary embodiment the purge operation is manually initiated and controlled by a pneumatic signal, those skilled in the art will readily understand that this control function can be realized many different ways. For example, a PLC or other electronic controller could automatically activate an electronic switch to initiate purge in accordance with a predetermined control algorithm. The control signal 212 could alternatively be an electrical control signal, for example.

Continuing with the exemplary embodiment of FIG. 5, the first switching valve 214 can be realized in the form of a pneumatically actuated valve, such as part no. 303082 available from Nordson Corporation. This valve can alternatively be controlled using an electrical control signal.

Source air 202 at line pressure is input (as at 216) to an inlet to the first switching valve 214. In response to the pulse control signal 212, the valve 214 outputs a pulsed purge air supply 218. This pulsed purge air 218 is input to a multiport manifold 220. The manifold 220 is simply a distribution block with a plurality of outlet ports connected to a common chamber. The manifold 220 has at least as many outlet ports as there are guns being operated within the powder coating system. FIG. 5 illustrates the detailed functions for a single gun control, but multiple guns will operate from the same pulsed purge air supply. The manifold thus distributes a plurality of pulsed purge air supplies 222, with the provision for additional guns being represented by the dashed lines in FIG. 5, thus there also being a separate shuttle valve for each gun.

The pulsed purge air 222 is coupled to a first inlet 224 of a second switching device 226. In this embodiment, the second switching device is realized in the form of a conventional shuttle valve, such as part no. OR 3 P10 available from Compair Pneumatics. Other switching devices could alternatively be used. In the case of multiple guns, there will be a second switching valve 226 for each pulse purge air input 222 from the manifold 220.

The shuttle valve 226 also has a second input 228 that receives the atomizing air 206 from the gun control module 200. The shuttle valve 226 has a single outlet 230. When the pulsed purge air 222 is present and the atomizing air is not present, the purge air passes through the shuttle valve 226. When the purge air 222 is not present, atomizing air when present passes through the shuttle valve 226. The shuttle valve thus acts as a switch to control atomizing air or purge air to the pump 20. The shuttle valve outlet 230 is coupled to the atomizing air inlet fitting 52 (FIGS. 1 and 3). Thus, when the operator or other mechanism selects a purging operation, high pressure pulsed purging air is immediately switched into the atomizing inlet 52 of the pump 20. This purge air passes through the hose 40 and purges and cleans the hose 40, and also purges and cleans the gun 30.

As noted herein before, the additional purge air function 208 can be separately used to purge the hose and gun by connecting the purge air 208 to the hose purge adapter inlet fitting 118 (FIG. 4) and the gun purge adapter fitting 46 (FIG. 2). When the purge inlet 118 arrangement is used, it may be desired to no longer purge through the atomizing inlet 52 and/or the flow rate air inlet 50, since the purge air into the hose inlet 118 will be sufficient to clean the hose, and the purge air into the pump mount 26 will be sufficient to purge the pump 20 and the tube 22. Thus, using the hose purge inlet 118 could avoid the need for the shuttle valve and switching control hardware and related functions that are otherwise used to switch purge air to the atomizing inlet 50 and optionally the flow rate air inlet 50. Of course, some systems may require the use of all the purging inlets and functions as set forth herein.

The manifold 220 further includes an additional pulsed purge air output 232 that is coupled to the purge air inlet 54 on the pump mount assembly 26. There can be provided a separate purge air outlet 232 for each pump 20 in the system. This purge air is at line pressure, however, the restricted orifice 110 limits the volume of air into the powder conduit 72 to a value that prevents separation of the pump 20 and the pump mount 26 or the pump mount and the hopper yet still assures adequate purging of the tube 22 and the pump 20.

Thus, a single pulsed purge air source can be used to purge the pump 20, the pick-up tube 22, the powder hose 40 and the gun 30. Additional and/or separate hose purging and gun purging can be accomplished using the purge adapters located at the pump discharge outlet and the gun inlet. The automatic switching arrangement between atomizing air and purge air reduces purging time and thus color changeover, as does the more efficient cleaning operations performed by the tube cleaning device 28 and the additional purging via the hose and gun purge adapters. Many different combinations and selections of each individual purging function can be incorporated into a particular powder coating system as desired or required.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. Purging apparatus for a powder coating system of the type having a powder supply, a powder pump that receives powder from the powder supply through a suction pick-up tube, a spray gun and a powder hose that connects the pump to the gun, comprising:

a purge air switch assembly;

a first air source that provides air at purge pressure to a first inlet of said purge air switch assembly;

a second air source that provides flow rate air to a first pump inlet and atomizing air to a second inlet of said purge air switch assembly;

wherein powder is drawn up the tube and into the pump by suction produced by flow rate air into the pump; and a purge inlet associated with a powder inlet to the pump;

the purge air switch assembly operating in response to a purge control signal to connect purge air to an atomizing inlet at the pump and to said purge inlet;

whereby the pump, hose and gun can be purged at the same time.

2. The apparatus of claim 1 wherein said purge air switch assembly operates to connect atomizing air to said atomizing inlet in the absence of said purge control signal.

3. The apparatus of claim 1 wherein said purge air is at line pressure and pulsed.

4. The apparatus of claim 1 wherein said purge inlet comprises a restricted orifice to reduce purge air pressure into said pump to prevent separation of the pump from the powder hose.

5. The apparatus of claim 4 wherein purge air into said purge inlet interrupts powder flow through the suction tube.

6. The apparatus of claim 5 wherein purge air into said purge inlet purges powder from the pick-up tube and the pump.

7. The apparatus of claim 6 wherein purge air into said atomizing inlet purges powder from the hose and the gun.

8. The apparatus of claim 1 wherein said purge air switch assembly comprises a valve switch and a manifold downstream from said valve switch; said valve switch being responsive to said control signal to provide pulsed purge air to said manifold.

9. The apparatus of claim 8 wherein said manifold distributes pulsed purge air to a second valve switch that connects said pulsed purge air to said atomizing inlet.

10. The apparatus of claim 9 wherein said second valve switch comprises a shuttle valve that connects atomizing air to said atomizing inlet in the absence of purge air, and connects purge air to said atomizing inlet when purge air is fed from said manifold to said shuttle valve.

11. The apparatus of claim 1 wherein said control signal is a pneumatic signal.

12. The apparatus of claim 1 wherein said control signal is an electrical signal.

13. The apparatus of claim 1 comprising a purge air inlet to the hose proximate a connection of the hose and the pump.

14. The apparatus of claim 13 comprising a purge air inlet to the hose proximate a connection of the hose and the gun.

15. The apparatus of claim 1 comprising means for cleaning an exterior surface of the pick-up tube as the tube is withdrawn from the powder supply.

16. The apparatus of claim 1 comprising:

a wiper device closely received on the pick-up tube exterior and stationary with respect to the tube;

said wiper device wiping powder off the tube exterior as the tube is at least partially withdrawn from the powder supply.

17. The apparatus of claim 16 wherein said wiper device comprises a seal having a friction fit about the tube exterior.

18. The apparatus of claim 17 wherein said seal comprises gum rubber.

19. The apparatus of claim 17 wherein said seal comprises an annular surface that defines a hole through said seal, wherein the tube passes through said hole and said annular surface wipes the tube exterior surface as the tube is inserted into and withdrawn from the powder supply.

20. The apparatus of claim 19 wherein said annular surface axially deflects in a direction of movement of the tube through said hole.

21. The apparatus of claim 16 comprising an adapter removably attachable to the powder supply; said wiper device being retained within said adapter.

22. The apparatus of claim 21 wherein said adapter is disposed within the powder supply.

23. A powder hose for a powder spray apparatus, comprising:

a hose having a fitting at a first end to connect the hose to a powder pump and a fitting at a second end to connect the hose to a powder spray apparatus;

a purge inlet assembly proximate said first end to admit air at purge pressure into the hose; and a second purge inlet assembly proximate said second end to admit air at purge pressure into the hose and spray apparatus.

24. Purging apparatus for a powder coating system of the type having a powder supply, a powder pump that receives powder from the powder supply through a suction pick-up tube, a spray gun and a powder hose that connects the pump to the gun, comprising:

a first purge air inlet to the hose proximate the pump/hose connection;

a second air source that provides flow rate air to a first pump inlet and atomizing air to an atomizing inlet of the pump;

wherein powder is drawn up the tube and into the pump by suction produced by flow rate air into the pump;

a second purge air inlet to the hose proximate the hose/gun connection; and a third purge air inlet proximate a powder inlet to the pump; and a purge air source that provides air at purge pressure to at least two of said first, second and third purge air inlets;

whereby at least two of the pump, hose and gun can be purged at the same time.

* * * * *